US006698603B2

(12) United States Patent
Lawson et al.

(10) Patent No.: US 6,698,603 B2
(45) Date of Patent: Mar. 2, 2004

(54) EXTENDABLE RACK

(76) Inventors: Stephen Lawson, 871 Wavertree Road, North Vancouver (CA), V7R 1S2; Christopher Isfeld, 36081 Regal Parkway, Abbotsford (CA), V3G 1L1

( * ) Notice: Subject to any disclaimer, the term of this patent is extended or adjusted under 35 U.S.C. 154(b) by 0 days.

(21) Appl. No.: 10/122,653

(22) Filed: Apr. 15, 2002

(65) Prior Publication Data

US 2003/0192845 A1 Oct. 16, 2003

(51) Int. Cl.[7] ..... A47F 5/08

(52) U.S. Cl. ..... 211/94.01; 312/334.4; 312/334.5

(58) Field of Search ..... 211/94.01; 312/334.5, 312/334.4, 334.7

(56) References Cited

U.S. PATENT DOCUMENTS

| | | | | | |
|---|---|---|---|---|---|
| 4,869,378 | A | * | 9/1989 | Miller | 211/94.01 |
| 5,412,912 | A | * | 5/1995 | Alves | 211/94.01 |
| 5,429,252 | A | * | 7/1995 | Liu | 211/94.01 |
| 5,740,927 | A | | 4/1998 | Yemini | |
| 5,794,795 | A | * | 8/1998 | Stemmons | 211/26 |
| 5,904,412 | A | * | 5/1999 | Lammens | 312/334.7 |
| 5,960,967 | A | | 10/1999 | Neil | |
| 6,050,426 | A | | 4/2000 | Leurdijk | |
| 6,119,878 | A | | 9/2000 | Zen | |
| 6,152,312 | A | * | 11/2000 | Nava et al. | 211/94.01 |
| 6,227,387 | B1 | | 5/2001 | Rose | |
| 6,367,889 | B1 | * | 4/2002 | Tsubouchi et al. | 303/113.4 |

* cited by examiner

*Primary Examiner*—Daniel P. Stodola
*Assistant Examiner*—Erica B Harris
(74) *Attorney, Agent, or Firm*—Frederick Kaufman

(57) ABSTRACT

An extendable rack is adapted for retaining one or more cantilever support(s) and is also adapted for attaching to a panel via a slide. The extendable rack comprises an elongated body including, at one side, a longitudinal channel for retaining one or more cantilever support(s); and, at another side, a longitudinal passage adapted for locating almost entirely the slide and for attaching permanently one side of it. Another side of the slide is firmly secured to the panel. In one embodiment, the longitudinal channel is C-shaped in cross section. Opposing niches are formed. Each opposing niche is adapted to capture at least a flange of at least one of several cantilever supports. In another embodiment, instead of the longitudinal channel, the elongated horizontal body comprises a central longitudinal wall extending, close to its top, outwardly and upwardly and forming a longitudinal top recess. Close to its bottom, the central longitudinal wall extends outwardly and downwardly forming a longitudinal bottom recess. The longitudinal top and bottom recesses are functionally equivalent to the niches. In another embodiment, the elongated horizontal body is provided with a central longitudinal wall extending, from midway of its height, outwardly, then upwardly and downwardly. Thus, longitudinal top and bottom recesses equivalent to the above recesses are formed.

5 Claims, 4 Drawing Sheets

EXTENDABLE RACK

I. BACKGROUND OF THE INVENTION

1. Field of the Invention

The present invention relates in general to storage racks for hanging a plurality of cantilever supports and, more particularly, to an extendable rack.

2. Description of the Prior Art

Racks particularly designed to fit inside wardrobes and/or wardrobe cabinets, or for wall mounting are well known. The consumer satisfaction depends upon several factors including reliability, easy access and minimal space required. Attempts have been made in the past to develop an improved rack. For example, U.S. Pat. No. 6,152,312, dated Nov. 28, 2000 and granted to Nava et al. for a "SUSPENDING SYSTEM FOR VARIOUS TYPES OF HANGING SUPPORTS, IN PARTICULAR DESIGNED TO FIT WARDROBES " describes a System structurally formed by three components, i.e., a section bar, a fastener and a bracket. The section bar comprises a front portion suitable for receiving various kinds of cantilever supports and a rear portion suitable for being assembled on the fastener. The latter is mounted and fastened to a carrier bracket. This suspending system is considered to have several disadvantages. First, the suspending system is cumbersome due to the overall width of the fastener and the carrier bracket. Second, Nava et al. suspending system requires special molds for manufacturing the fastener and the carrier bracket. As a result the total cost of the hanging system appears to be relatively high. U.S. Pat. No. 4,569,450, dated Feb. 11$^{th}$ 1986 and granted to Dillingham for a "NECKTIE STORAGE WITH FOLDING HANGER MEMBERS" describes an apparel support device particularly adapted for hanging a plurality of neckties. The apparel support device comprises an elongated base member having a longitudinal channel defined by opposed side walls and elongated parallel opposed grooves formed in the side walls. A plurality of hanger members is used. Each hanger member has a shank portion and an integral crank end portion connected to a link at spaced apart intervals on the link. The device comprises as well an elongated channel shaped hanger support having a web portion and spaced apart parallel flanges connected to the web portion and supported at their distal end in the grooves. Crank supports are provided on the parallel side flanges for supporting and retaining the hanger members. Dillingham's device has shortcomings. It is complicated. It uses numerous components and does not provide a structural rigidity, required by this type of devices.

II. SUMMARY OF THE INVENTION

In view of the above considerations based on the identified prior art, there is a need to address rack design concerns and, consequently, to develop a rack that eliminates or, at least, alleviates the foregoing disadvantages and shortcomings.

Thus, a first objective of the present invention is to provide an extendable rack which is reliable, simple and allows the material and labor costs to be reduced. Such savings may be passed to the users, which constitute an undeniable advantage. A second objective of this invention is to provide a well-engineered extendable rack characterized by compactness and including a well-tested, mass produced slide.

Broadly stating, the present invention provides an extendable rack adapted for retaining one or more cantilever support(s) and also adapted for attaching to a panel via a slide. The extendable rack comprises an elongated body including, at one side, means for retaining one or more cantilever support(s); and, at another side, a longitudinal passage adapted for locating almost entirely and for attaching permanently the slide that is also firmly secured to the panel.

In accordance with one aspect of the present invention, the means for retaining one or more cantilever support(s) includes an elongated horizontal body provided with a longitudinal channel, C-shaped in cross section, with a perimeter defined by a standing segment extending, at the top, into a downwardly curved segment and, at the bottom, into an upwardly curved segment, so that opposing niches are formed. Each opposing niche is adapted to capture at least a flange of at least one of several cantilever supports.

In accordance with another aspect of the present invention, the means for retaining one or more cantilever support(s) includes an elongated horizontal body provided with a central longitudinal wall, extending, close to the top, outwardly and upwardly and forming a longitudinal top recess. Close to the bottom, the central longitudinal wall extends outwardly and downwardly forming a longitudinal bottom recess. The longitudinal top and bottom recesses are adapted to capture at least one flange of at least one of several cantilever supports.

In accordance with still another aspect of the present invention, the means for retaining one or more cantilever support(s) is provided with a central longitudinal wall extending from midway of its height, outwardly, then upwardly and downwardly, thus forming longitudinal top and bottom recesses adapted to capture at least one flange of at least one of several cantilever supports.

In a last aspect of the present invention, the elongated horizontal body, having longitudinal cavities, is provided, at a front extremity, with a finger-pull having upper and lower projections for press fitting into the longitudinal cavities. A cap attached to a back extremity of the elongated horizontal body also comprises upper and lower projections for press fitting into the longitudinal cavities.

III. BRIEF DESCRIPTION OF THE DRAWINGS

Although the characteristic features of this invention will be particularly pointed out in the claims, the invention itself and the manner in which it may be made and used, may be better understood by referring to the following description taken in connection with the accompanying drawings forming part hereof, wherein like reference numerals refer to like parts throughout the several views in which:

Figure 2:
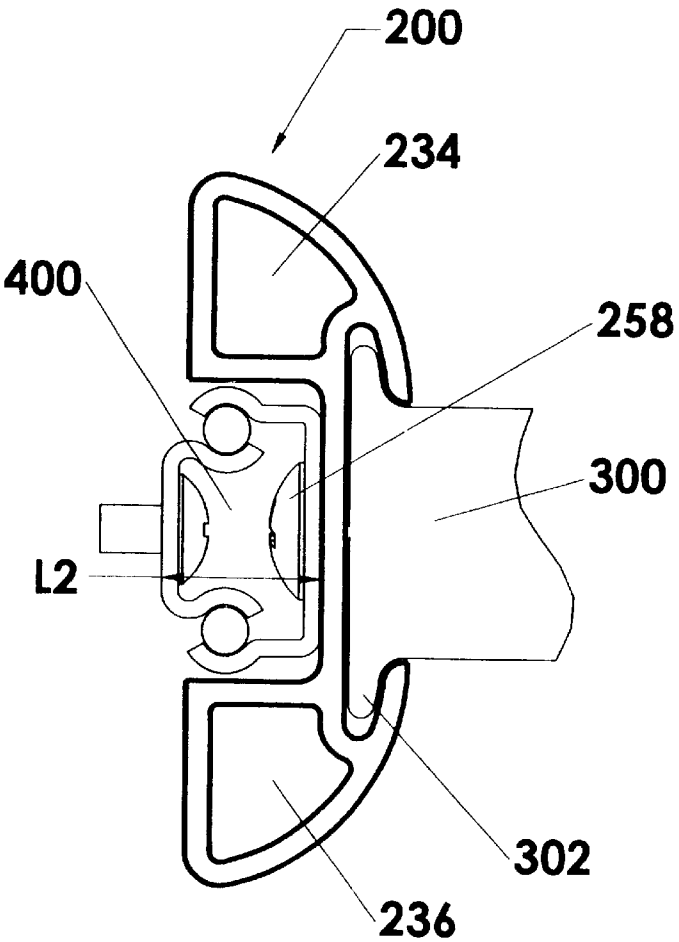
FIG. 2 illustrates a transversal cross section of the elongated horizontal body according to a first embodiment.
Figure 2:
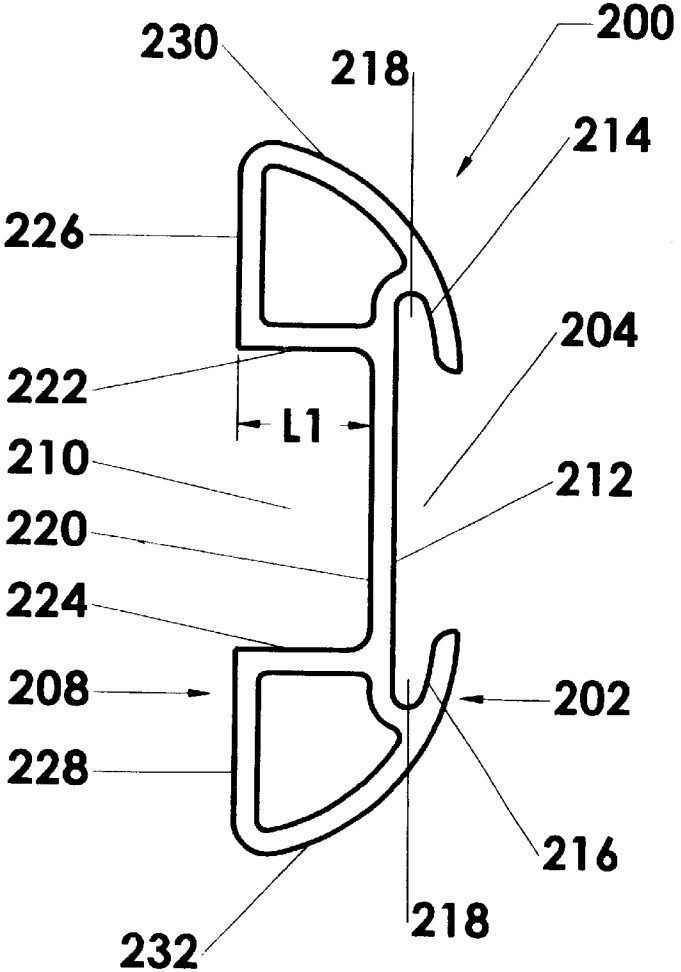
Figure 3:
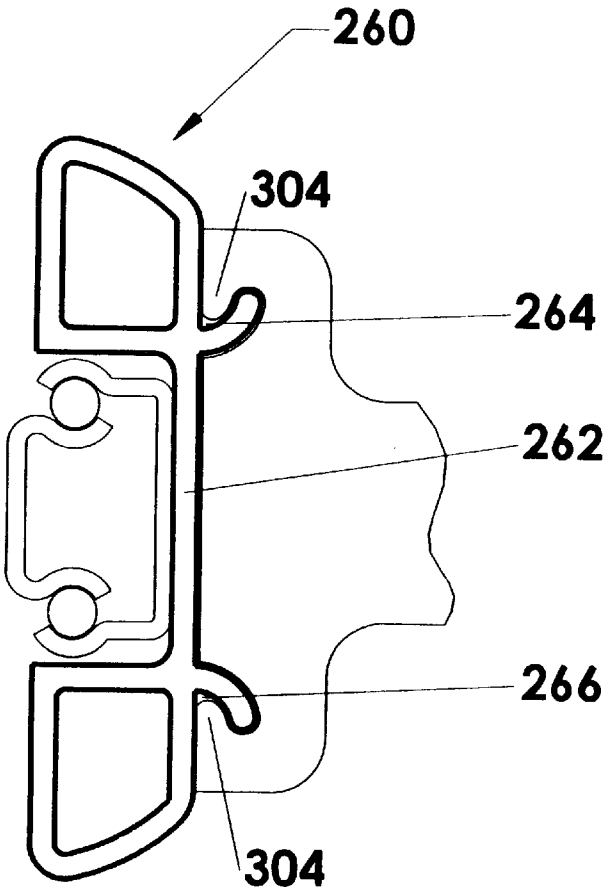
Figure 4:
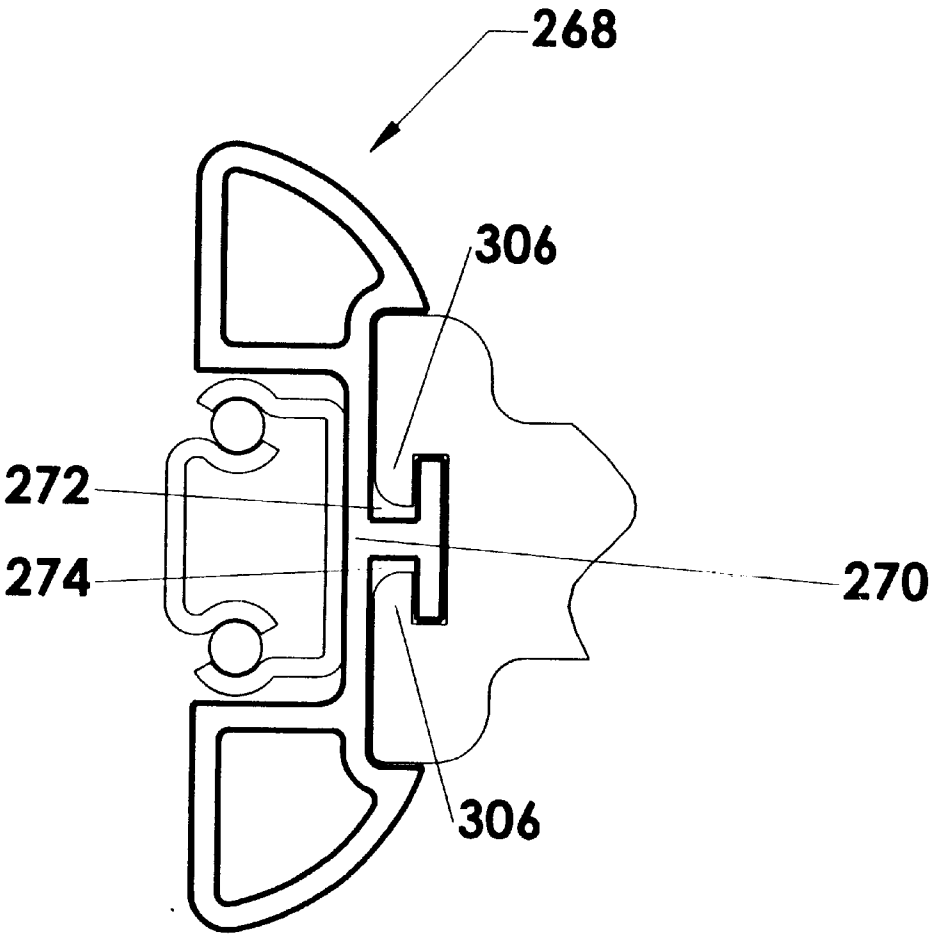

FIG. 2' illustrates the cross section of FIG. 2 together with a cantilever support and a slide, the former and the latter shown in phantom lines;

FIG. 3 illustrates transversal cross section of the elongated horizontal body according to a second embodiment; and FIG. 4 illustrates transversal cross section of the elongated horizontal body according to a third embodiment.

III. DESCRIPTION OF THE PREFFERED EMBODIMENTS

Figure 1:
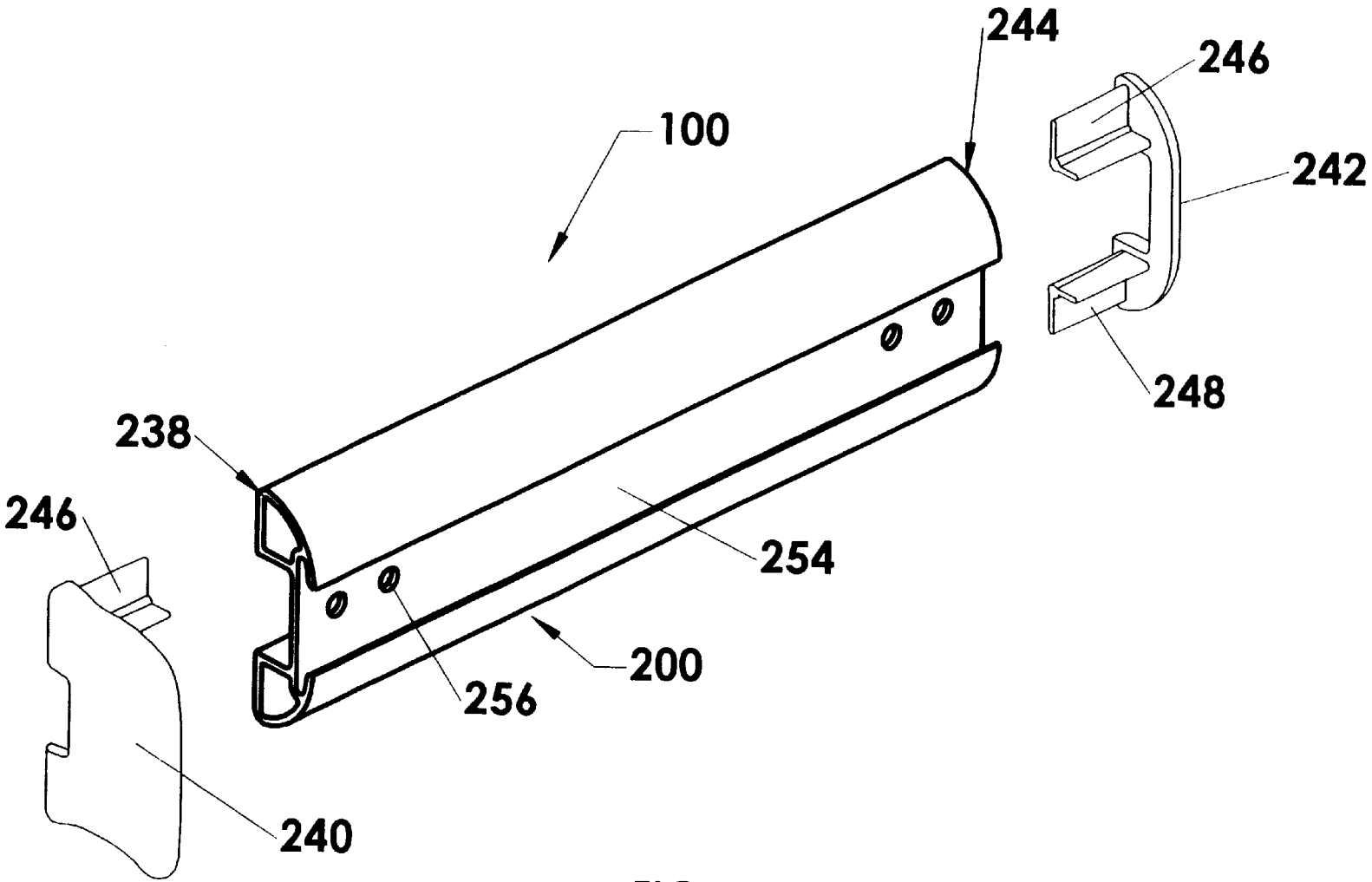
FIG. 1 illustrates in an exploded, perspective view the extendable rack, according to the present invention.

An extendable rack 100, as shown in FIG. 1, comprises essentially an elongated horizontal body 200.

It is to be agreed, that terms such as "horizontal", "top", "bottom", "outwardly", "upwardly" and "downwardly" are conventionally used in the present description with reference to the normal position in which extendable rack 100 would be used.

In general, (see FIGS. 2 and 2') extendable rack 100 has its elongated horizontal body 200 provided, in a first side 202, with a longitudinal channel 204. The latter is adapted for retaining one or more cantilever supports 300. Elongated horizontal body 200 is provided in a second side 208, usually opposed to first side 202, with a longitudinal passage 210.

The latter is adapted for locating almost entirely a slide 400 and for attaching permanently one side of the latter; other sides of slide 400 being firmly secured to a fixed panel (not shown). Thus, elongated horizontal body 200 is suitable for being glidingly assembled on slide 400.

Referring now in detail to FIGS. 2 and 2', in a first embodiment, elongated horizontal body 200 has longitudinal channel 204, C-shaped in cross section, with a perimeter defined by a standing segment 212 extending, at the top, into a downwardly curved segment 214 and, at the bottom, into an upwardly curved segment 216. Opposing niches 218 are formed. Each opposing niche 218 is adapted to capture a flange 302 of cantilever support 300.

Longitudinal channel 204 extends along elongated horizontal body 200.

Elongated horizontal body 200 has longitudinal passage 210 with U-shaped in cross section, and a length also commensurate with elongated horizontal body 200. Longitudinal passage 210 has one upright segment 220 extending at the top and at the bottom into horizontal segments 222 and 224. Joints formed between upright segment 220 and horizontal segments 222 and 224 are rounded. A first horizontal dimension L1 of longitudinal passage 210 is lesser than a second horizontal dimension L2 of a mounted slide 400. Thus, slide 400 extends laterally beyond horizontal passage 210. A movement of elongated horizontal body 200, with respect to a part of slide 400, which is attached to a fixed panel, is therefore possible.

Each horizontal segment 222 and 224 continues, at each outside extremity, with vertical segments 226 and 228, respectively opposed, which further continues with a curved segment 230 and 232, to finally merge with downwardly and upwardly projecting segments 214 and 216.

As a result, longitudinal cavities 234 and 236 having lengths commensurate with the lengths of longitudinal channel 204 and longitudinal passage 210 are formed.

Conveniently, a finger-pull 240 is attached to a front extremity 238 of elongated horizontal body 200, while a cap 242 is attached to a back extremity 244 of the same. Finger-pull 240 and cap 242 comprise upper and lower projections 246 and 248 press fitted into longitudinal cavities 234 and 236. Front and back extremities 238 and 244 are closed by finger-pull 240 and by cap 242. Finger-pull 240 is used to drive elongated horizontal body 200 outwardly and inwardly.

A wall 254, formed between standing segment 212 and upright segment 220, contains, at each extremity, holes 256 located midway between the horizontal segments 222 and 224. Fasteners 258 disposed in holes 256 are used to attach slide 400 to elongated horizontal body 200.

In a second embodiment, (see FIG. 3), an elongated horizontal body 260 has a central longitudinal wall 262. Central longitudinal wall 262, close to its top, extends outwardly and upwardly and forms a longitudinal top recess 264. At the bottom, central longitudinal wall 262, close to its bottom, extends outwardly and downwardly forming a longitudinal bottom recess 266. The purpose of longitudinal top and bottom recesses 264 and 266 is to retain opposite flanges 304.

The remaining features of elongated horizontal body 260 are essentially similar with those described in elongated horizontal body 200.

In a third embodiment, (see FIG. 4), an elongated horizontal body 268 has a central longitudinal wall 270. The latter extends, from midway of its height, outwardly, then upwardly and downwardly forming longitudinal top and bottom recesses 272 and 274, respectively. The purpose of longitudinal top and bottom recesses 272 and 274 is to retain opposite flanges 306.

The remaining features of elongated horizontal body 268 are essentially similar with those described in elongated horizontal body 200.

Elongated horizontal bodies 200, 260 and 268 are advantageously formed by an extrusion process. Aluminum, plastic and wood composite are usually used. Since slider 400 is of a conventional and known design, mass-produced in different sizes, a further explanation of the same appears to be unnecessary. For example, precision ball bearing drawer slides are sold under the trademark Accuride™ by Accuride, Santa Fe Springs, Calif.

Cantilever supports 300 are designed in various shapes to accommodate different items, such as neckties, belts, trays etc.

As required, detailed embodiments of the present invention are disclosed herein; however, it is to be understood that the disclosed embodiments are merely exemplary of the invention, which may be embodied in various forms. Therefore, specific structural and functional details disclosed therein are not to be interpreted as limiting, but merely as a basis for the claims and as a representative basis for teaching one skilled in the art to variously employ the present invention in virtually any appropriately detailed structure.

What is claimed is:

1. Extendable rack comprising, in combination, an elongated horizontal body provided in a first side with a longitudinal channel having means for retaining at least one cantilever support;

in a second opposite side with a longitudinal passage; and a ball bearing drawer slide located almost entirely within said longitudinal passage, said ball bearing drawer slide having one side permanently attached to said longitudinal passage and another side adapted to be firmly secured to a fixed panel, whereby said elongated body is suitable for being glidingly assembled on said ball bearing drawer slide.

2. Extendable rack, as defined in claim 1, wherein said means for retaining at least one cantilever support includes said elongated horizontal body provided with a longitudinal channel, C-shaped in cross section, with a perimeter defined by a standing segment extending, at the top, into a downwardly curved segment and, at the bottom, into an upwardly curved segment, so that opposing niches are formed, each opposing niche being adapted to capture at least a flange of at least one of said cantilever supports.

3. Extendable rack, as defined in claim 1, wherein said means for retaining at least one cantilever support includes said elongated horizontal body provided with a central longitudinal wall extending, close to its top, outwardly and upwardly and forming a longitudinal top recess and, at the bottom, said central longitudinal wall extends, close to its bottom, outwardly and downwardly forming a longitudinal bottom recess, said longitudinal top and bottom recesses being adapted to capture at least one flange.

4. Extendable rack, as defined in claim 1, wherein said means for retaining at least one cantilever support includes an elongated horizontal body provided with a central longitudinal wall extending from midway of its height, outwardly, then upwardly and downwardly, thus forming longitudinal top and bottom recesses adapted to capture at least one flange of at least one of said cantilever supports.

5. Extendable rack, as defined in claim 1, wherein said means for retaining at least one cantilever support includes an elongated horizontal body provided with longitudinal cavities;

a finger-pull having upper and lower projections for press fitting into said longitudinal cavities, at a front extremity of said elongated horizontal body; and a cap attached to a back extremity of said elongated horizontal body, said cap also comprises said upper and lower projections for press fitting into said longitudinal cavities.

* * * * *